United States Patent [19]

Kramming

[11] 3,967,775

[45] July 6, 1976

[54] METHOD OF STORING HANDLE BAGS

[75] Inventor: Erik Kramming, Saltsjobaden, Sweden

[73] Assignee: Bengt Lundin AB, Arvika, Sweden

[22] Filed: June 13, 1975

[21] Appl. No.: 586,694

Related U.S. Application Data

[62] Division of Ser. No. 415,854, Nov. 14, 1973.

[30] Foreign Application Priority Data

Nov. 24, 1972 Sweden ..... 15339/72

[52] U.S. Cl. ..... 229/54 R; 229/62; 206/425; 206/466; 206/493; 206/806

[51] Int. Cl.[2] ..... B65D 33/08

[58] Field of Search.... 206/493, 495, 806, 486–490, 206/466, 425; 221/312 R, 312 A, 312 B, 312 C, 45; 229/54 R, 53, 62, 52 R, 66, 52 A, 52 B

[56] References Cited

UNITED STATES PATENTS

| | | | |
|---|---|---|---|
| 3,162,305 | 12/1964 | Schoppa | 206/493 |
| 3,180,528 | 4/1965 | Balint et al. | 206/806 |
| 3,285,407 | 11/1966 | Abramson | 206/493 |
| 3,352,411 | 11/1967 | Schwarzkopf | 206/493 |
| 3,380,579 | 4/1968 | Pinto | 206/493 |
| 3,385,428 | 5/1968 | Kugler | 206/493 |

*Primary Examiner*—George LE. Lowrance
*Assistant Examiner*—Joseph M. Moy
*Attorney, Agent, or Firm*—Fred Philpitt

[57] ABSTRACT

A bundle of two-handle bags arranged so as to better insure that only one bag at a time will be removed.

1 Claim, 2 Drawing Figures

METHOD OF STORING HANDLE BAGS

This is a division of application Ser. No. 415,854, filed Nov. 14, 1973.

In bags with handle openings, and particularly with plastic bags, it has long been a problem to take from a bundle of bags only one bag at a time and to open the bag. It is not possible, either, to simply stack plastic bags, because the bags will slide or flow after a certain time, unless the stack or bundle is held together. This problem is specially evident at cash registers in self-service shops where the customers are expected to take one bag at a time from a stock and to fill the bag with articles. It was found that the customers in many cases take more bags than necessary and thereby cause economic waste.

The present invention has as its object to eliminate the aforesaid problems and, in addition, provide the possibility of easier filling the bags with articles.

Figure 1:
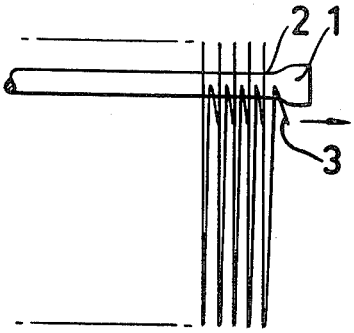
Figure 2:
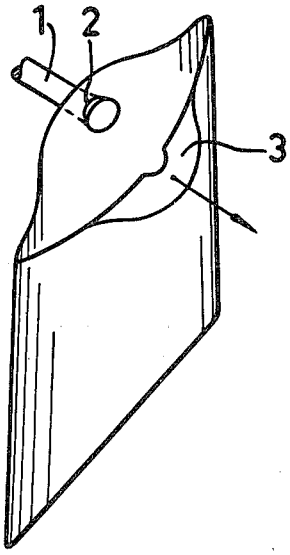

The invention is described in greater detail hereinafter, with reference to the accompanying drawing, in which FIG. 1 shows a side view of the invention with the bags disposed on an elongated support member, and FIG. 2 shows a perspective view of a bag which has been moved to the end of its elongated supporting member and is in a partially opened condition.

According to FIG. 1, the bags are suspended on a rod 1 in such a manner that one of the first of the two handle openings 2 is fitted over the rod. The second of the two handle openings 3 is folded down so as to be locate below the rod 1. Said rod 1 has a dimension, which substantially corresponds to the size of the handle opening, and at the end of the rod 1 a thickening may be provided so that when the bag is drawn off there is some resistance from the rod 1.

The bags, thus, are in bundles fitted on the rod 1, and the second of the two handle opening 3, which is folded downwards, faces in the direction, in which the bags are drawn off from the rod 1. Due to the fact that the handle opening 3 is folded down, it is easy to seize said handle opening with one hand and draw off the bag from the rod. There is no risk of subsequent bags following along therewith, and the bags, can thus be taken from the rod 1 one at a time. When a suitable inertia or friction engagement exists between the rod 1 and the first handle opening 2, the bag will open itself whilst it is being drawn off the supporting rod and thereby will render it possible to place articles into the open bag. This is facilitated as the bag is seized only with one hand, and the other hand is free for placing articles into the bag.

In the embodiment shown, the bags are arranged freely suspended from a horizontal rod 1, but variations are imaginable and suitable. The rod 1 may be arranged inclined, and lateral supports for the bags may be provided to prevent the bags from swinging forth and back on the rod 1. Furthermore, a bottom support for the bag may be provided in the form of a plate or the like, which plate may extend past the end of rod 1 and constitute a plane for placing the bag thereon after it has been filled or for filling it with articles.

The drawings also, show a special embodiment of the bag in which the handle openings are disposed above the bag edges. This is not necessary, but the only necessary requirement is that one handle opening can be folded down. A great number of variations of such bags exist. A possible variation is that the bag is a conventional paper bag with two handles arranged at the upper edge of the bag. Also such a bag can suitably be used for realizing the invention. The rod 1, furthermore, in the embodiment shown is round, but several other shapes may be used. It is essential, however, that a certain agreement exists between the cross-sectional shape of the rod 1 and the handle openings, in order to achieve all of the aforementioned advantages of the invention. It should be emphasized, however, that the rod, for example, may have the form of a board placed on edge and having a longest dimension in the cross-sectional shape which coincides with the dimension of the handle opening in the corresponding direction.

What I claim is:

1. A bundle of plastic bags arranged in a stacked side-by-side relationship each of the bags in said bundle having a first handle opening located on one side of the bag, each of the bags in said bundle having a second handle opening located on the side opposite to the side containing said first handle opening, the first handle opening of each bag being aligned with the first handle opening of every other bag in the bundle, the second handle opening of each bag being aligned with the second handle opening of every other bag, the pattern established by the alignment of said first handle openings being disposed at least partially out of alignment with the pattern established by the alignment of said second handle openings, said bundle of plastic bags being adapted to be slideably supported on an elongated supporting member that has a discharge end that is shaped to control the removal of only one bag at a time over the discharge end of the elongated supporting member, whereby, when the bundle of plastic bags is slideably supported on an elongated supporting member that has a discharge end that is shaped to permit the removal of only one bag at a time, removal of one bag at a time can be effected from said bundle by first pulling the side containing the second handle opening over the discharge end of the elongated supporting member and outwardly until the first handle opening is inhibited against further outward sliding movement by the discharge end of the elongated sliding member, thus opening the interior of the bag so that it can be loaded with the desired number of items.

* * * * *